United States Patent [19]

Loch

[11] 4,323,433

[45] Apr. 6, 1982

[54] ANODIZING PROCESS EMPLOYING ADJUSTABLE SHIELD FOR SUSPENDED CATHODE

[75] Inventor: David M. Loch, Seattle, Wash.

[73] Assignee: The Boeing Company, Seattle, Wash.

[21] Appl. No.: 189,089

[22] Filed: Sep. 22, 1980

[51] Int. Cl.[3] ..... C25D 11/02; C25D 17/00

[52] U.S. Cl. ..... 204/56 R; 204/279; 204/DIG. 7

[58] Field of Search ..... 204/279, 280, DIG. 7, 204/15, 58, 56 R

[56] References Cited

U.S. PATENT DOCUMENTS 2,072,170 3/1937 Herzog ..... 204/279
2,419,383 4/1947 Ames ..... 204/279
3,322,658 5/1967 Sem ..... 204/290 R
4,077,864 3/1978 Vanderveer ..... 204/DIG. 7

FOREIGN PATENT DOCUMENTS 37-16820 10/1962 Japan ..... 204/DIG. 7

*Primary Examiner*—T. Tufariello
*Attorney, Agent, or Firm*—Thomas H. Murray

[57] ABSTRACT

An anodizing process having a suspended cathode having a casing of non-electrically conductive material to shield the upper portion of the cathode from effective anodizing communication with the electrolytic bath. The shield can be positioned selectively relative to the length of the cathode whereby the effective area of electrolytic communication can be controlled.

5 Claims, 2 Drawing Figures

ANODIZING PROCESS EMPLOYING ADJUSTABLE SHIELD FOR SUSPENDED CATHODE

BACKGROUND OF THE INVENTION

1. Field of the Invention

This invention relates to an anodizing process employing adjustable shields for suspended cathodes.

2. Description of the Prior Art

Suspended electrodes in electrolytic baths are employed as cathodes in metal plating installations and as anodes in anodizing installations. See British Pat. No. 665,599 and U.S. Pat. No. 2,833,710.

For optimum electroplating, it is important to control the ratio of surface area of anode-to-cathode. This control has been accomplished heretofore by increasing or decreasing the number of anodes which are employed in an electroplating bath. In some installations, where more precise control is demanded for product quality, a portion of the surface area of one or more anodes has been covered with tape to reduce the surface exposure of the taped anode. This procedure is labor intensive, although effective.

In hard anodizing installations, it is important to control the ratio of surface area of cathode-to-anode. If the ratio is too small, the anodizing rate is reduced. If the ratio is too large, local coating degradation known as "burning" may occur.

Accordingly, it is desirable to provide an effective, convenient means for adjusting the surface area of a suspended electrode which is maintained in effective electrolytic communication with an electrolytic bath whereby the surface area of the controlled electrode to the surface area of the parts undergoing treatment can be regulated.

SUMMARY OF THE INVENTION

An adjustable, electrically non-conductive casing is provided which shields the upper portion of a suspended electrode from effective communication with an electrolytic bath. The bottom portion of the suspended electrode extends below the bottom wall of the casing and is in effective electrolytic communication with the electrolytic bath. Securing means are provided to support the casing in relation to the suspended electrode. By adjusting the securing means, more or less of the suspended electrode can be positioned below the bottom wall of the casing in electrolytic communication with the electrolytic bath. Thereby, the ratio of the exposed surface area of the shielded electrode to the surface area of the parts undergoing treatment in the electrolytic bath can be conveniently regulated.

DESCRIPTION OF THE PREFERRED EMBODIMENTS

Figure 1:
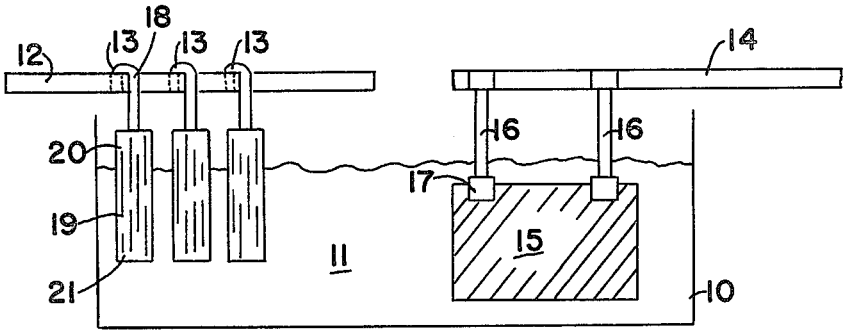
FIG. 1 is a schematic illustration of a typical electrolytic bath including suspended electrodes.

A typical electrolytic treatment process is illustrated in FIG. 1 wherein a vat 10 contains an electrolytic bath 11. A bus bar 12 has suspended electrodes 13 which are in electrical contact with the bus bar 12 and which are suspended into the electrolytic bath 11. A bus bar 14, of opposite polarity from the bus bar 12, is connected to a part 15 which is being treated in the process. The part 15 is connected to the bus bar 14 by means of suspended clamps 16 which have clamping elements 17 holding the part 15.

Where the installation of FIG. 1 is an electrolytic plating bath, the suspended electrodes 13 are anodes and the part 15 which is being treated is a cathode. In an anodizing process, the suspended electrodes are cathodes and the part 15 which is being treated is an anode. The quality of the products from both processes depends in some measure upon the ratio of surface area of the suspended electrodes 13 to the surface area of the part 15 undergoing treatment.

It will be observed that each of the electrodes 13 includes a hook member 18 and an electrolytic material 19. The electrolytic material 19 has a top end 20 normally maintained above the upper level of the bath 11 and a bottom end 21 normally immersed within the bath 11.

Figure 2:
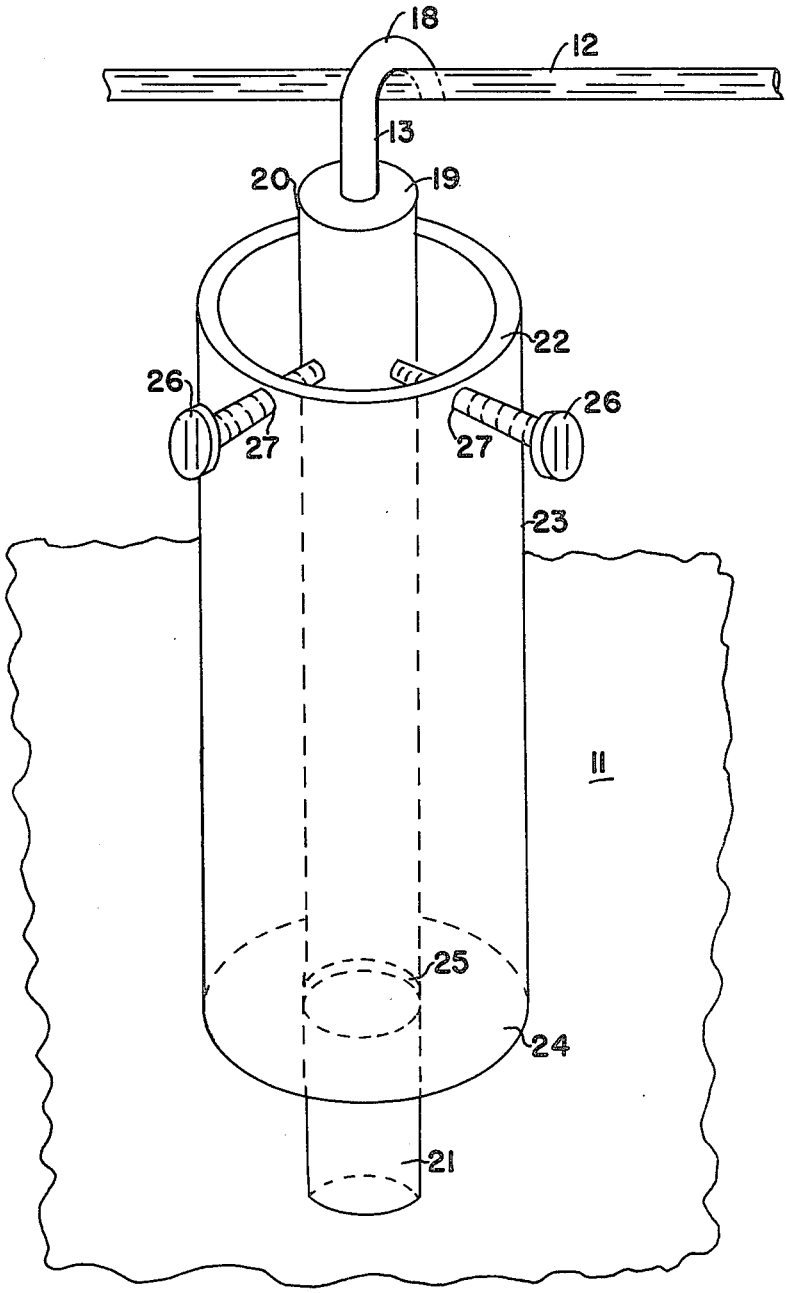
FIG. 2 is a perspective illustration of a suspended electrode having a typical adjustable shield in accordance with the present invention.

Referring to FIG. 2, the electrode 13 is suspended by means of the hook 18 from the bus bar 12 into an electrolytic bath 11. A casing 22 constitutes the electrode shield of this invention. The casing 22 includes vertical side walls 23, a bottom wall 24 having a central opening 25 through which the bottom end 21 of the electrolytic material 19 extends. Screws 26 are a securing means and extend through screw-receiving openings 27 in the side walls 23 to permit the casing 22 to be retained in an adjustably fixed relationship with respect to the electrolytic material 19.

It will be observed that the casing 22 can be moved upwardly, thereby increasing the surface area of the bottom end 21 of electrolytic material 19 which is exposed in electrolytic communication with the bath 11. Similarly, the casing 22 may be moved downwardly to decrease the surface area of the bottom end 21 which is exposed in electrolytic communication with the bath 11.

The inner diameter of the side walls 23 preferably is only slightly larger than the outer diameter of the electrolytic material 19, whereby the annular space between the electrolytic material 19 and the casing 22 is insignificant. In an alternative embodiment, the inner diameter of the side walls 23 of casing 22 may be such that a frictional engagement with the outer surface of the electrolytic material 19 supplies the necessary securing means for supporting the casing 22 in relation to the suspended electrode 13. In this alternative embodiment, the bottom wall 24 is eliminated and the bottom end of the side walls 23 constitutes the opening 25 through which the electrolytic material 19 extends.

The casing 22 is fabricated from electrically non-conductive materials which will resist corrosion in the bath 11. Typically, the casing may be fabricated from thermoplastic or thermosetting plastic material such as polymethylmethacrylate, polyethylene, polyvinyl chloride, polyvinyl fluoride, polyesters, polyamides, polypropylene or polybutylene.

Where screws 26 are employed to support the casing 22, they are preferably distributed about the periphery of the casing to serve as spacers as well as fastening means. The screws 26 are fabricated from materials which will resist corrosion when in contact with the bath 11.

While the electrolytic material 19 has been illustrated as a cylinder, other electrode configurations are well known, for example, square cross sections, triangular cross sections, oval cross sections, and rectangular cross sections with smooth or corrugated surfaces. To accommodate these other shaped electrodes, the casing 22 can be correspondingly shaped or can be retained in the cylindrical configuration illustrated in FIG. 2. Preferably the central opening 25 will correspond in shape to the cross-sectional shape of the electrode.

Suspended electrodes in sheet-like configuration also are known wherein the sheet electrode may be a solid metal sheet or a mesh ribbon or perforated sheet. In order to accommodate such sheet-like suspended electrodes, the present shield will be provided with a corresponding rectangular cross section.

Suspended electrodes are known wherein an electrically conductive basket, containing pieces of electrolytic material, is suspended from a bus bar into an electrolytic bath. The basket walls are such that the electrolytic pieces will be in communication with the electrolytic bath. The present invention may be applied to such basket electrodes by providing a casing which fits over the side walls of the basket.

In the electroplating installations, the ratio of anode surface area to cathode surface area preferably is in the range of 41: to 1:1. Other ranges may be employed according to the recommendations or requirements of the electroplating system.

In anodizing installations, the ratio of cathode surface area to anode surface area is preferably 1:12 to 1:2. The optimum ratio is about 1:4.

I claim:

1. In an anodizing process utilizing an anodizing bath, an anode and a suspended cathode, the improvement comprising positioning for said suspended cathode an electrically nonconductive casing having an upper end, a lower end, side walls and a bottom opening;

said side walls being annularly spaced from said suspended cathode;

said casing having a bottom wall having a perimeter connected to said side walls and having a central opening which constitutes the said bottom opening of the casing;

said bottom opening receiving the bottom end of a suspended cathode, the inner surface of said side walls being annularly spaced from the said suspended cathode; and securing means for supporting the said casing relative to the said suspended cathode whereby only that portion of the suspended cathode which extends through the said bottom opening is in effective electrolytic communication with the said anodizing bath.

2. The anodizing process of claim 1 wherein the said securing means are screws extending through spaced screw-receiving openings adjacent to the said upper end of the said casing.

3. The anodizing process of claim 1 wherein the said casing is fabricated from electrically non-conductive materials.

4. The anodizing process of claim 3 wherein the said electrically non-conductive materials are plastic.

5. The anodizing process of claim 1 wherein the inner walls of said casing correspond to the side walls of a basket cathode.

* * * * *